US007722519B2

(12) United States Patent
Timmers et al.

(10) Patent No.: US 7,722,519 B2
(45) Date of Patent: May 25, 2010

(54) DUNNAGE CONVERSION MACHINE AND METHOD

(75) Inventors: Mike J. Timmers, Landgraaf (NL); Jos Saive, Bocholtz (NL); Dan Coppus, Doenrade (NL); Raimond Demers, Landgraaf (NL); Erwin Methorst, Neerbeek (NL); Erwin Riga, Sittard (NL)

(73) Assignee: Ranpak Corporation, Concord Township, OH (US)

( * ) Notice: Subject to any disclaimer, the term of this patent is extended or adjusted under 35 U.S.C. 154(b) by 0 days.

(21) Appl. No.: 11/209,204

(22) Filed: Aug. 22, 2005

(65) Prior Publication Data

US 2006/0128545 A1 Jun. 15, 2006

Related U.S. Application Data

(60) Provisional application No. 60/603,223, filed on Aug. 20, 2004, provisional application No. 60/625,518, filed on Nov. 5, 2004, provisional application No. 60/667,977, filed on Apr. 4, 2005.

(51) Int. Cl.
*B31B 1/00* (2006.01)

(52) U.S. Cl. ..... 493/352; 493/464; 493/967

(58) Field of Classification Search ..... 493/352, 493/395, 464, 967
See application file for complete search history.

(56) References Cited

U.S. PATENT DOCUMENTS

| | | | | | |
|---|---|---|---|---|---|
| 1,927,849 | A * | 9/1933 | Roberts | 26/77 |
| 2,577,195 | A * | 12/1951 | Johnson | 226/23 |
| 2,593,157 | A * | 4/1952 | Lorig | 226/192 |
| 3,907,186 | A * | 9/1975 | Hasler | 226/7 |
| 3,942,735 | A * | 3/1976 | Marchio et al. | 242/527 |
| 4,750,896 | A | 6/1988 | Komaransky | |
| 4,834,359 | A * | 5/1989 | Raabe | 270/30.07 |
| 5,322,477 | A | 6/1994 | Armington | |
| 5,373,935 | A * | 12/1994 | Anderson | 198/808 |
| 5,989,176 | A | 11/1999 | Ratzel | |
| 6,033,353 | A | 3/2000 | Lencoski | |
| 6,210,310 | B1 * | 4/2001 | Manley | 493/464 |
| 6,699,167 | B2 * | 3/2004 | Manley | 493/464 |
| 6,758,801 | B2 | 7/2004 | Harding | |
| 6,843,762 | B2 * | 1/2005 | Munche et al. | 492/40 |
| 7,172,548 | B2 | 2/2007 | Toth | |
| 2004/0266598 | A1 | 12/2004 | Toth | |

FOREIGN PATENT DOCUMENTS

EP 1066955 A2 1/2001

* cited by examiner

*Primary Examiner*—Hemant M Desai
(74) *Attorney, Agent, or Firm*—Renner, Otto, Boisselle & Sklar, LLP

(57) ABSTRACT

A dunnage conversion machine (10) and corresponding method for converting a supply of sheet stock material into a relatively less dense dunnage product includes a conversion assembly (20) that converts sheet stock material into a dunnage product, and a tension-adjusting assembly (26) having a sequence of transversely extending members (28) disposed upstream of the conversion assembly (20). The transversely extending members (28) engage the stock material and help to prevent or to minimize excessive edge tension and/or the tearing associated therewith, while maintaining sufficient tension for proper tracking, especially for the conversion of single ply, lesser quality and/or short fiber paper, and/or otherwise improves or enhances the conversion process. The transversely extending members (28) are generally aligned end-to-end, and define a path for the stock material from a supply thereof, via a stock supply assembly (15) to the conversion assembly (20).

10 Claims, 17 Drawing Sheets

DUNNAGE CONVERSION MACHINE AND METHOD

The present invention hereby claims the benefit of U.S. Provisional Patent Application No. 60/603,223, filed Aug. 20, 2004, U.S. Provisional Application No. 60/625,518, filed Nov. 5, 2004, and U.S. Provisional Application No. 60/667,977, filed Apr. 4, 2005, each of which is hereby incorporated herein by reference.

FIELD OF THE INVENTION

The present invention generally relates to a dunnage conversion machine and method for converting sheet stock material into a dunnage product. More particularly, the present invention relates to a conversion machine with transversely extending members that engage the stock material upstream of a conversion assembly.

BACKGROUND

In the process of shipping an item from one location to another, a protective packaging material is typically placed in the shipping case, or box, to fill any voids and/or to cushion the item during the shipping process. Since paper is biodegradable, recyclable and produced from a renewable resource, paper protective packaging material is increasingly popular. While paper or other sheet stock material could be used as a protective packaging material, it is usually preferable to convert the sheet material into a relatively lower density dunnage product. This conversion can be accomplished by a conversion machine, such as that disclosed in U.S. Pat. No. 5,322,477. This patent is assigned to the assignee of the present application and its entire disclosure is hereby incorporated herein by reference.

The conversion machine disclosed in U.S. Pat. No. 5,322,477 includes a conversion assembly that converts multi-ply stock material into a lower density dunnage product, and a stock supply assembly that supplies the multi-ply stock material to the conversion assembly. The conversion assembly includes a forming assembly that inwardly turns the lateral regions of the stock material as it travels downstream therethrough. As a result of this inward turning, the lateral regions of the stock material are subject to edge tension that sometimes results in ripping or tearing of the stock material at the lateral edges.

SUMMARY

The present invention provides a dunnage conversion machine and method characterized by a stock supply arrangement that helps to minimize or prevent excessive edge tension and/or the tearing associated therewith, especially for the conversion of single ply, lesser quality and/or short fiber paper, and/or otherwise improves or enhances the conversion process, while at the same time providing sufficient tension across the width of the stock material to ensure that the stock material maintains its alignment as it is formed into a strip of dunnage.

In particular, the present invention provides a dunnage conversion machine for converting a supply of sheet stock material into a relatively less dense dunnage product that includes a conversion assembly that converts sheet stock material into a dunnage product, and a sequence or series of transversely extending members disposed upstream of the conversion assembly. The transversely extending members typically are aligned generally end-to-end, and define a path for the stock material from a supply thereof to the conversion assembly.

In addition, the present invention provides a conversion machine that includes one or more of the following features:

A. a forming assembly that shapes the sheet stock material and a feeding/fixing assembly that draws the stock material through the forming assembly and fixes the shaped stock material to form a dunnage product, B. at least one transversely extending member in the form of a roller, C. at least two transversely extending members in the sequence of transversely extending members, D. the sequence of transversely extending members being arrayed along a straight line, E. the sequence of transversely extending members being arrayed along a curved line, F. at least one adjustment mechanism that provides for adjustment of the angle between adjacent transversely extending members, G. at least one of the transversely extending members having a diameter that varies along its length, H. at least one of the transversely extending members having at least one rounded end, and/or I. a constant-entry roller upstream of the sequence of transversely extending members that provides a constant point in the path of the stock material from a supply thereof to the sequence of transversely extending members as stock material is drawn from the supply. The torturous path over the constant-entry roller and under the sequence of transversely extending members, in combination with the curvature of the transversely extending members across the width of the stock material, serves to maintain sufficient tension in the stock material to encourage proper alignment of the stock material widthwise as it tracks through the converter.

The transversely extending members typically are positioned in the path of the stock material from a supply thereof to the conversion assembly in a manner that allows a more gradual transition between the supply of the stock material to the conversion assembly and the inward turning of lateral regions of the stock material by the conversion assembly. Such a gradual transition is believed to reduce edge-tension in the stock material and/or otherwise enhance the conversion process.

The present invention also provides a method of making a dunnage product from a sheet stock material that includes the following steps: (a) drawing sheet stock material from a supply thereof over a sequence of transversely extending members that are generally aligned end-to-end, and (b) converting the sheet stock material into a relatively lower density dunnage product downstream of the transversely extending members. The method can additionally include the step of changing the angle between at least one pair of adjacent transversely extending members. Additionally or alternatively the converting step can further include the steps of (i) turning the lateral edges of the stock material inward, (ii) crumpling the stock material, and/or (iii) fixing the stock material in its crumpled state.

The foregoing and other features of the invention are shown in the drawings and particularly pointed out in the claims. The following description and annexed drawings set forth in detail one or more illustrative embodiments of the invention; this being indicative, however, of but one or a few of the various ways in which the principles of the invention might be employed.

DETAILED DESCRIPTION

Figure 1:
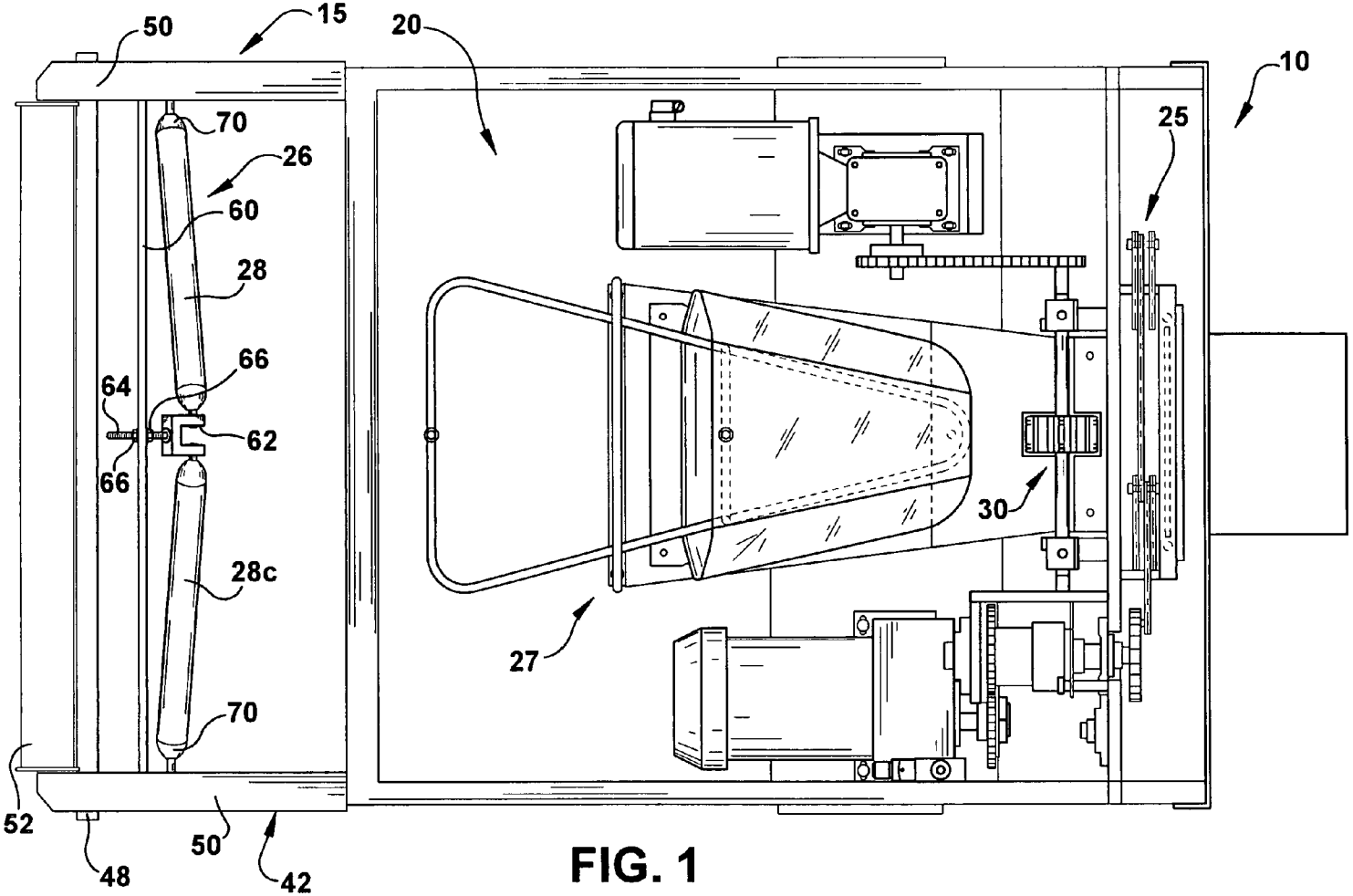
FIG. 1 is a top view of an exemplary dunnage conversion machine, specifically a cushioning conversion machine, in accordance with the invention with the top wall of the machine's housing nearest the viewer removed to reveal internal machine components.
Figure 2:
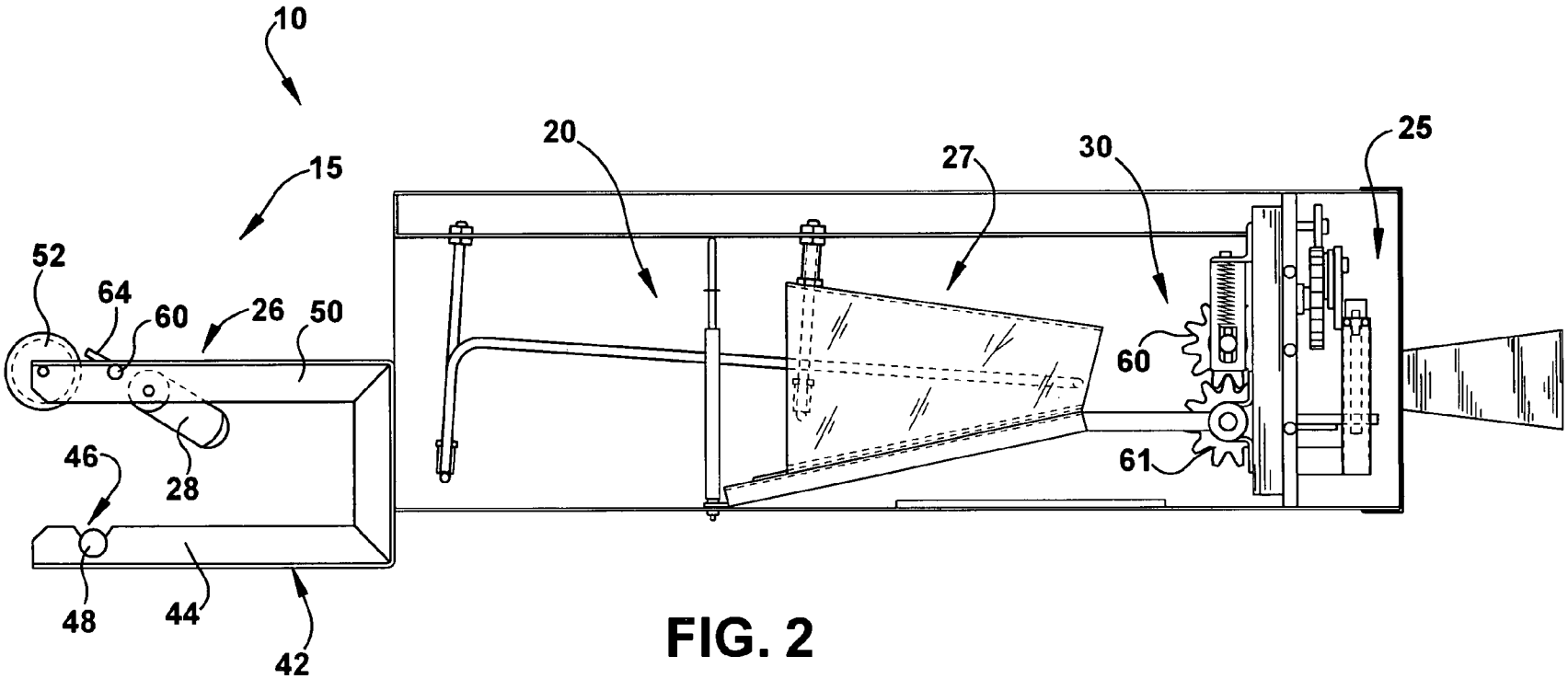
FIG. 2 is a side view of the cushioning conversion machine of FIG. 1, with the side wall of the machine's housing nearest the viewer removed to reveal the internal machine components.

Referring now in detail to the drawings and initially to FIGS. 1 and 2, these figures show an exemplary embodiment of a dunnage conversion machine provided by the present invention for converting a supply of sheet stock material into a relatively less dense dunnage product. In particular, the illustrated dunnage conversion machine is a cushioning conversion machine 10 that includes a stock material supply assembly 15, a conversion assembly 20 for converting sheet stock material into a relatively lower density strip of cushioning dunnage, and a severing assembly 25 for severing the strip to form discrete sections of a given length, commonly referred to as pads. The conversion machine 10 also includes a tension-adjusting assembly 26 that includes a sequence of transversely extending members 28. The transversely extending members 28 are disposed upstream of the conversion assembly 20 and extend transversely across the path of, and help to define the path of, the stock material from the supply assembly 15 to the conversion assembly 20. The transversely extending members 28 generally minimize or prevent excessive edge tension and/or the tearing associated therewith while maintaining sufficient tension to ensure proper tracking, especially for the conversion of single ply, lesser quality and/or short fiber paper, and/or otherwise improves or enhances the conversion process as the stock material moves through the conversion assembly 20.

The conversion assembly 20 preferably includes a forming assembly 27 and a feed assembly 30. The feed assembly 30 includes two opposed rotating members 60 and 61 which, according to a preferred embodiment, are meshed coining gears. One rotating member, such as the upper rotating member 60, is driven while the other rotating member, in this case the lower rotating member 61, is driven due to an interaction with the driven rotating member 60. In this case the teeth of the rotating members 60 and 61 mesh with one another to transfer the driving force.

During the conversion process, sheet stock material is pulled from the stock supply assembly 15 and transferred to the conversion assembly 20, which converts the sheet stock material into a continuous strip of cushioning dunnage. More specifically, as the feed assembly 30 pulls the stock material in a downstream direction from the stock supply assembly 15 through the forming assembly 27, the forming assembly 27 crumples the stock material and causes the lateral edges of the stock material to turn, roll or fold inwardly to form a continuous strip having two lateral pillow portions with a central portion therebetween. The lateral edges typically overlap one another in the central portion.

The feed assembly 30 performs a "pulling" function by drawing the continuous strip through the nip of the two cooperating and opposed rotating members 60 and 61 of the feed assembly 30, thereby drawing stock material through the forming assembly 27. The rotating members 60 and 61 additionally perform a "coining" or a "connecting" function as the opposed rotating members 60 and 61 coin a central band (of the central portion) of the continuous strip as it passes therethrough to form a coined strip.

As the connected (coined) strip travels downstream from the feed assembly 30, the strip passes through the severing assembly 25. The severing assembly 25 severs discrete dunnage products of a desired length, in the form of sections or cushioning pads, from the strip of cushioning for use as a protective packaging material.

The terms "upstream" and "downstream" are characteristic of the direction of flow of the stock material through the machine 10. In FIG. 2 the machine is positioned in a substantially horizontal orientation whereby an imaginary longitudinal line or axis from the upstream end near the stock supply assembly 15 to the downstream end near the severing assembly 25 would be substantially horizontal.

The illustrated stock material supply assembly 15 includes a pair of laterally spaced apart U-shape brackets 42 secured to the rear or upstream end of the machine's housing. The lower legs 44 of the brackets 42 have open slots 46 in their distal ends to cradle a supply rod 48. The supply rod 48 is designed to extend relatively loosely through a hollow tube of a stock roll. As the stock material is pulled from the stock supply assembly 15, the tube will freely rotate to dispense the stock material. A pin (not shown) can be provided through one or both ends of the supply rod 48 to limit or prevent rotation of the supply rod 48 itself.

The upper projecting legs 50 of the brackets 42 have journalled therebetween a cylindrical constant entry roller 52 that provides a substantially non-varying point of entry for the sheet stock material from a supply of stock material, whether in the form of a stock roll or fan-folded stack, e.g., as the stock material is withdrawn therefrom. For further details concerning an exemplary constant entry roller, please see U.S. Pat. Nos. 4,750,896 and 6,033,353, both of which are hereby incorporated herein by reference.

The upper legs 50 of the brackets 42 also support the tension-adjusting assembly 26 downstream of the constant entry roller 52. Alternatively, the tension-adjusting assembly 26 can function as a constant entry device and the constant entry roller 52 can be omitted. The tension-adjusting assembly 26 generally includes the aforementioned sequence or series of transversely extending members 28 disposed to engage the stock material as it is pulled from the stock supply assembly 15. This usually means that the transversely extending members 28 extend across most of the span between the brackets, preferably but not necessarily across the width of the stock material.

The transversely extending members 28 generally are positioned to distribute tension in the stock material widthwise across the stock material, thereby minimizing or preventing excessive edge tension and/or the tearing associated therewith to improve or enhance the conversion process. Yet the transversely extending members can also add tension to the stock material to ensure proper tracking of the stock material into and through the conversion assembly 20. In cooperation with the constant entry roller 52, the transversely extending members 28 provide tension to the stock material as it follows a torturous path over the constant entry roller 52 and under the widthwise curvature of the arc of transversely extending members 28. The amount of tension in the stock material is preferably sufficient to encourage proper tracking of the stock material into the conversion assembly but insufficient to cause tearing of the stock material or interference with the conversion process. The amount of tension is dependent on the type of stock material that is used. The transversely extending members 28 also can be positioned without significantly affecting the tension distribution, but to still guide the stock material in a way that also would tend to improve or enhance the conversion process.

The tension-adjusting assembly 26 also includes a support rod 60 mounted to the legs 50 of the brackets 42, and one or more supplemental brackets or yokes 62 supporting the transversely extending members 28 between the brackets 42. In the illustrated tension-adjusting assembly 26, the ends of the transversely extending members 28 at the opposite ends of the sequence are journalled to respective brackets 42, and the other ends of the transversely extending members 28 are journalled to the yokes 62 mounted to the support rod 60. The illustrated yokes 62 have a Y-shape, but their shape is only limited by their ability to support the ends of the transversely extending members 28 with respect to the support rod 60.

Figure 3:
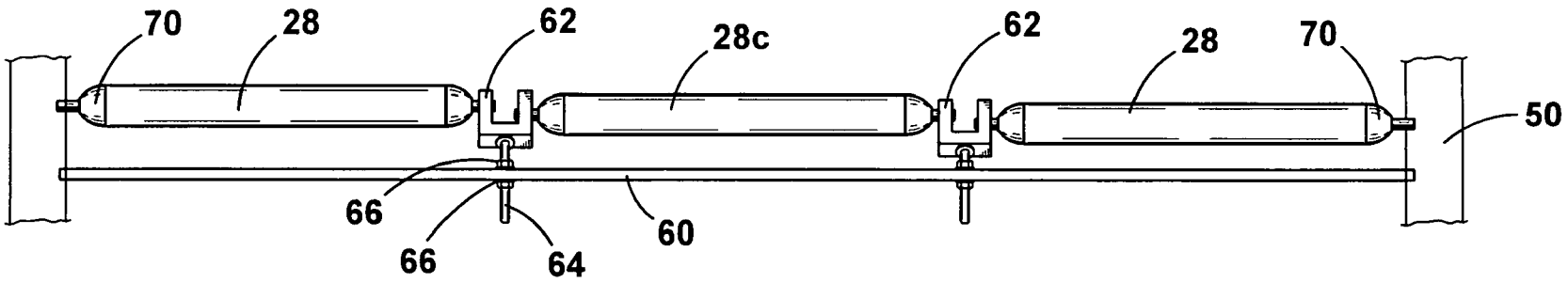
FIGS. 3 and 4 are top views of alternate embodiments of a sequence of transversely extending members provided by the present invention.
Figure 4:
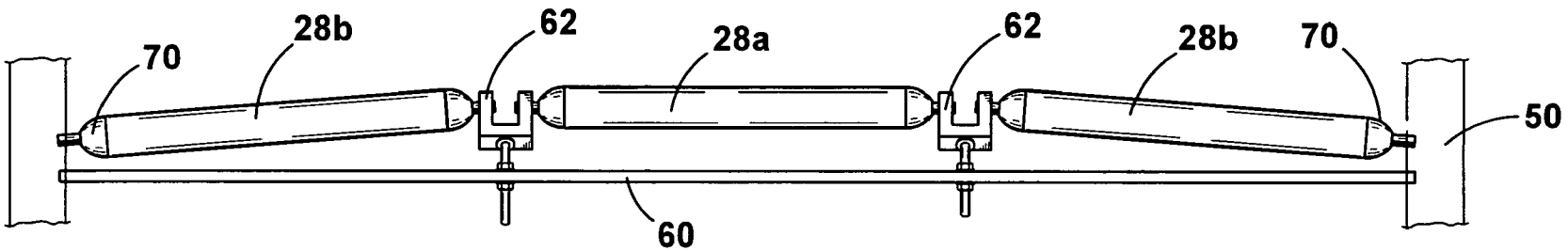

The transversely extending members 28 generally are arrayed end-to-end along a line. The yokes 62 generally also provide the ability to adjust the orientation of the transversely extending members 28. For example, the illustrated yokes 62 include a threaded bolt 64 that forms the end of the Y and passes through an opening in the support rod 60. This bolt 64 is attached to the support rod 60 with a pair of nuts 66 secured on opposite sides of the rod 60. Thus, by repositioning the nuts 66 to shift the position of the threaded bolt 64 relative to the rod 60, the position of the respective transversely extending members 28 relative to the support rod 60 can be adjusted to support the transversely extending members 28 at different angular orientations relative to one another, and/or to support the transversely extending members 28 at different distances relative to the support rod 60. Thus, the transversely extending members 28 can be arrayed in a straight line, as shown in FIG. 3, for example, or can be arrayed along a curved line, as shown in FIGS. 1 and 4. The amount of curvature and the shape of the curvature can be adjusted by adjusting one or more yokes 62 that support the transversely extending members 28 relative to the support bar 60.

When the transversely extending members 28 are arrayed along a straight line in a direction perpendicular to the downstream direction of the flow of the stock material, the stock material traveling over the tension-adjusting assembly 26 is forced to follow a generally straight transverse path and is restricted in the ability of lateral portions of the stock material to turn inwardly in the same direction as the conversion assembly 20 urges those portions of the stock material. This can affect the conversion process by, for example, resulting in excessive tension in the lateral regions which sometimes leads to ripping or tearing of the paper.

By providing rounded ends 70 at lateral reaches of the sequence of transversely extending members 28, the tension-adjusting assembly 26 allows a more gradual transition between the stock supply assembly 15 and the conversion assembly 20 and facilitates the inward turning of the lateral edges by the conversion assembly 20. Such an arrangement is believed to reduce edge-tension in the stock material and/or otherwise enhance the conversion process. This process can be further enhanced by arranging the sequence of transversely extending members 28 along a curved line in a direction complementary to the inward turning action imparted by the conversion assembly 20. Such a curved arrangement of the transversely extending members 28 is believed to enhance the transition between the stock supply assembly 15 and the conversion assembly 20.

Figure 5:
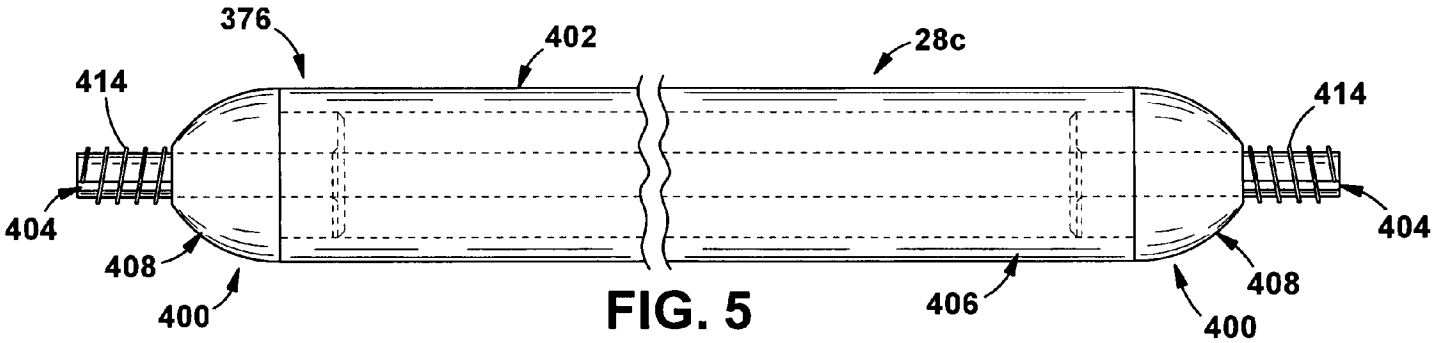
FIGS. 5-9 are top views of exemplary transversely extending members that can be used with other members of the same type or in combination with different types of transversely extending members in the sequence of transversely extending members in accordance with the present invention.
Figure 6:
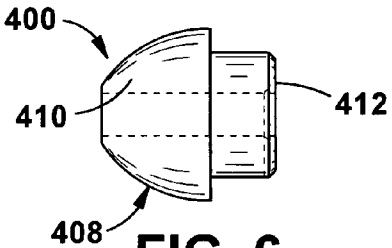
Figure 7:
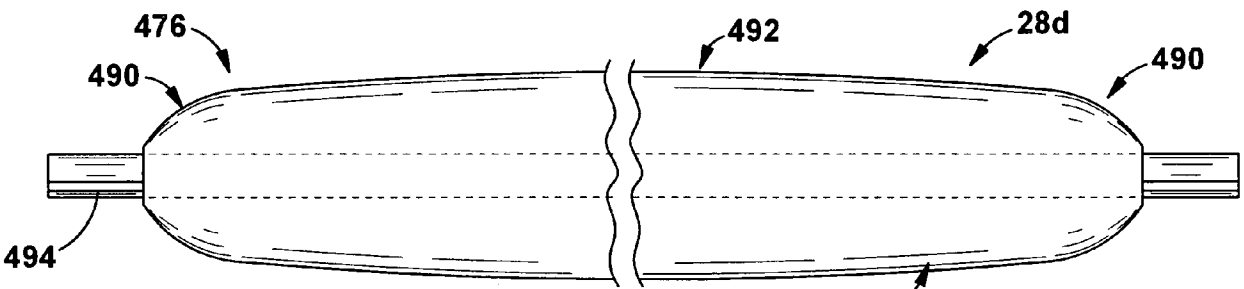
Figure 8:
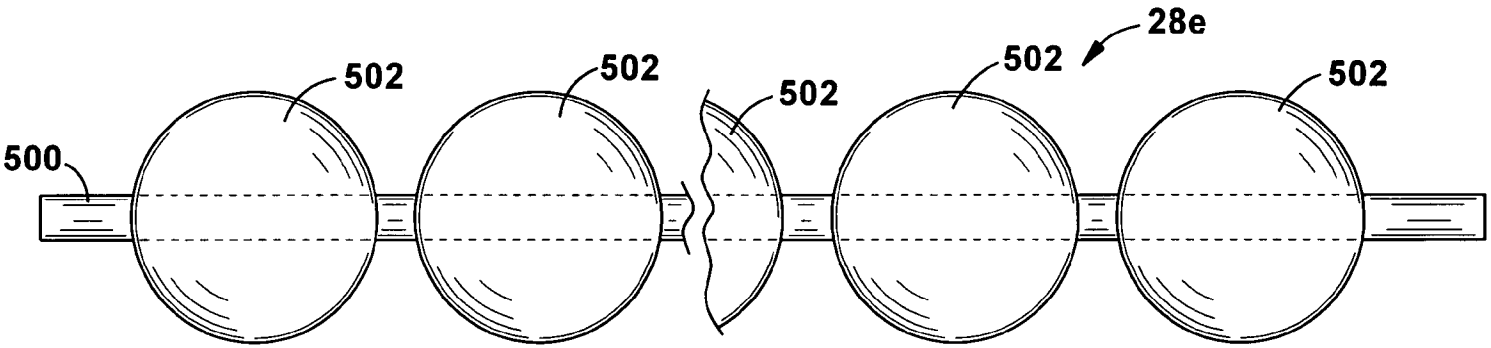
Figure 9:
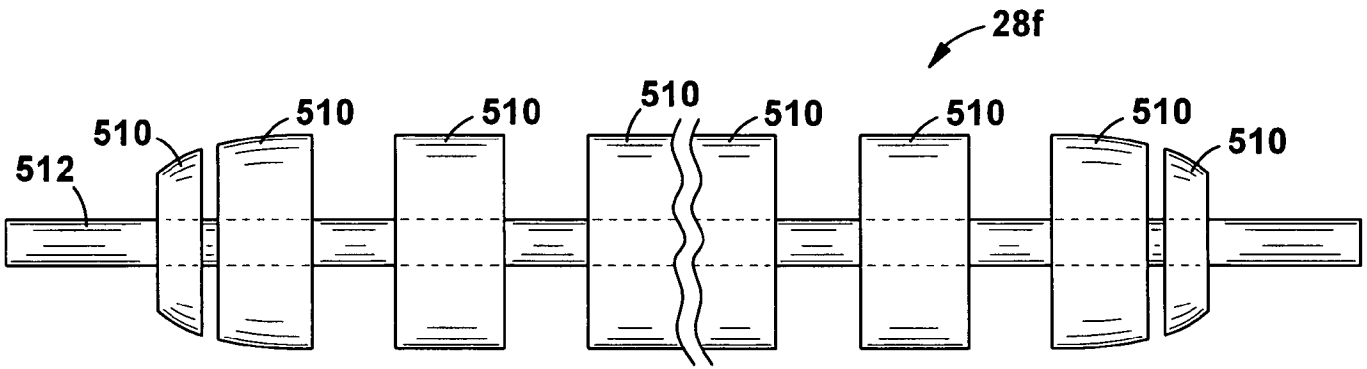

As is apparent from FIGS. 3-9, individual transversely extending members 28 can take a variety of forms, including cylindrical (the middle member 28*a* in FIG. 4), cylindrical with one rounded end (left and right members 28*b* in FIG. 4), cylindrical with a pair of rounded ends 28*c* (FIGS. 1, 3 and 5), and varying diameters 28*d*, 28*e*, 28*f* (FIGS. 7-9). As described below with respect to specific examples, each transversely extending member 28 typically includes a central rod and one or more sleeves that are rotatably mounted around the rods. Each sleeve has a circular cross-sectional shape, but can have different diameters along the length of the rod. Different combinations of types of transversely extending members 28 with different sizes and shapes are contemplated within the scope of the present invention.

An exemplary transversely extending member 28*c*/376 is shown in FIG. 5. The transversely extending member 376 includes end portions 400 and a central portion 402 extending therebetween. The end portions 400 are inwardly tapered relative to the central portion 402 towards the respective ends of the member 376. The inwardly tapered lateral end portions 400 of the member 376 can be positioned to engage an edge of the lateral portions of the stock material. In this manner, an edge of the stock material engaging that part of the transversely extending member 376 is not forced to follow a straight transverse path. Instead, the lateral portion of the stock material is inwardly urged in the same direction as the conversion assembly inwardly turns the lateral edge of the stock material. This allows a gradual transition between the tension-adjusting assembly 26 and the conversion assembly thereby reducing the chance of excessive edge-tension and/or otherwise enhancing the conversion process.

The illustrated transversely extending member 376 includes a rod 404, a sleeve 406, and a pair of end caps 408 connected to each end of the sleeve 406. The rod 404 is non-rotatably mountable and the sleeve 406 and caps 408 are rotatably mounted about the rod 404. The sleeve 406 forms the center portion 402 of the separating member 376 and is cylindrical with a constant circular radial cross-sectional shape along its axial dimension.

The caps 408 each include a head 410 and a plug 412 connected to the head 410. The head 410 forms the inwardly tapering end portions 400 of the separating member 376. The head 410 has a circular radial cross-section shape which decreases in size along its axial dimension and an axial cross-sectional shape resembling a top-truncated parabola. (FIG. 6.) The plugs 412 extend from the axially inner end of the respective head 410 and are sized for tight inserted receipt into the ends of the sleeve 406 whereby the sleeve 406 will not rotate relative to the end caps 408. The end caps 408 are preferably made of suitable material, such as plastic, so that they form a bearing surface relative to the rod 404. The transversely extending member 476 also includes a pair of springs 614 positioned around the rod 494 on opposite sides of the sleeve 496, to provided biased transverse centering of the sleeve 496.

Another transversely extending member 28*d*/476 is shown in FIG. 7, which includes inwardly tapered end portions 490 and a central portion 492 extending therebetween. The transversely extending member 476 includes a rod 494 and a sleeve 496 that is mounted for rotation around the rod 494. The sleeve 496 forms the central portion 492 of the member and also the inwardly tapered lateral end portions 490 of the member. In the illustrated embodiment, the sleeve 496 is cylindrical and has a circular radial cross-sectional shape which changes size along its axial dimension. The radial cross-sectional size of the sleeve 496 preferably changes gradually along the central portion 492 of the transversely extending member and more dramatically along the lateral end portions 492 of the transversely extending member 476.

Further alternatives are evident in FIGS. 8 and 9. In FIG. 8, a transversely extending member 28*e* includes a central rod 500 and a plurality of spaced balls 502 mounted to the rod 500. The balls 502 can be rotatably mounted to the rod 500 or affixed to the rod and the rod can be rotatably mounted to the brackets 42 (FIG. 1) and/or the yokes 62 (FIG. 1). In this configuration, the transversely extending member 28*e* will have reduced contact with the stock material, which could reduce friction with the transversely extending member 28*e*, or if the stock material moves into the spaces between the balls 502 this could enhance the crumpling action of the conversion assembly 20 (FIG. 1), which could be desirable in certain circumstances.

A similar effect could be produced by the transversely extending member 28*f* shown in FIG. 9. In this case, the transversely extending member 28*f* includes a plurality of spaced apart plates 510 mounted to a central rod 512. Again, note that the plates 510 have different diameters along the length of the rod 512, along with the spaces between the plates.

Each of the transversely extending members discussed herein might be more or less advantageous for different types of dunnage conversion machines, and the present invention is not limited to use in the illustrated cushioning conversion machine or the illustrated types of transversely extending members. These and other transversely extending members also can be used in other types of dunnage conversion machines.

When a cushioning conversion machine incorporating such a tension-adjusting assembly is used, the resulting method includes the following steps: (a) drawing sheet stock material from a supply thereof over a sequence of transversely extending members, and (b) converting the sheet stock material into a relatively lower density dunnage product downstream of the transversely extending members. The method can additionally include changing the angle between at least one pair of adjacent transversely extending members. Additionally or alternatively, the converting step can further include the steps of (i) turning the lateral edges of the stock material inward, (ii) crumpling the stock material, and (iii) fixing the stock material in its crumpled state.

Figure 10:
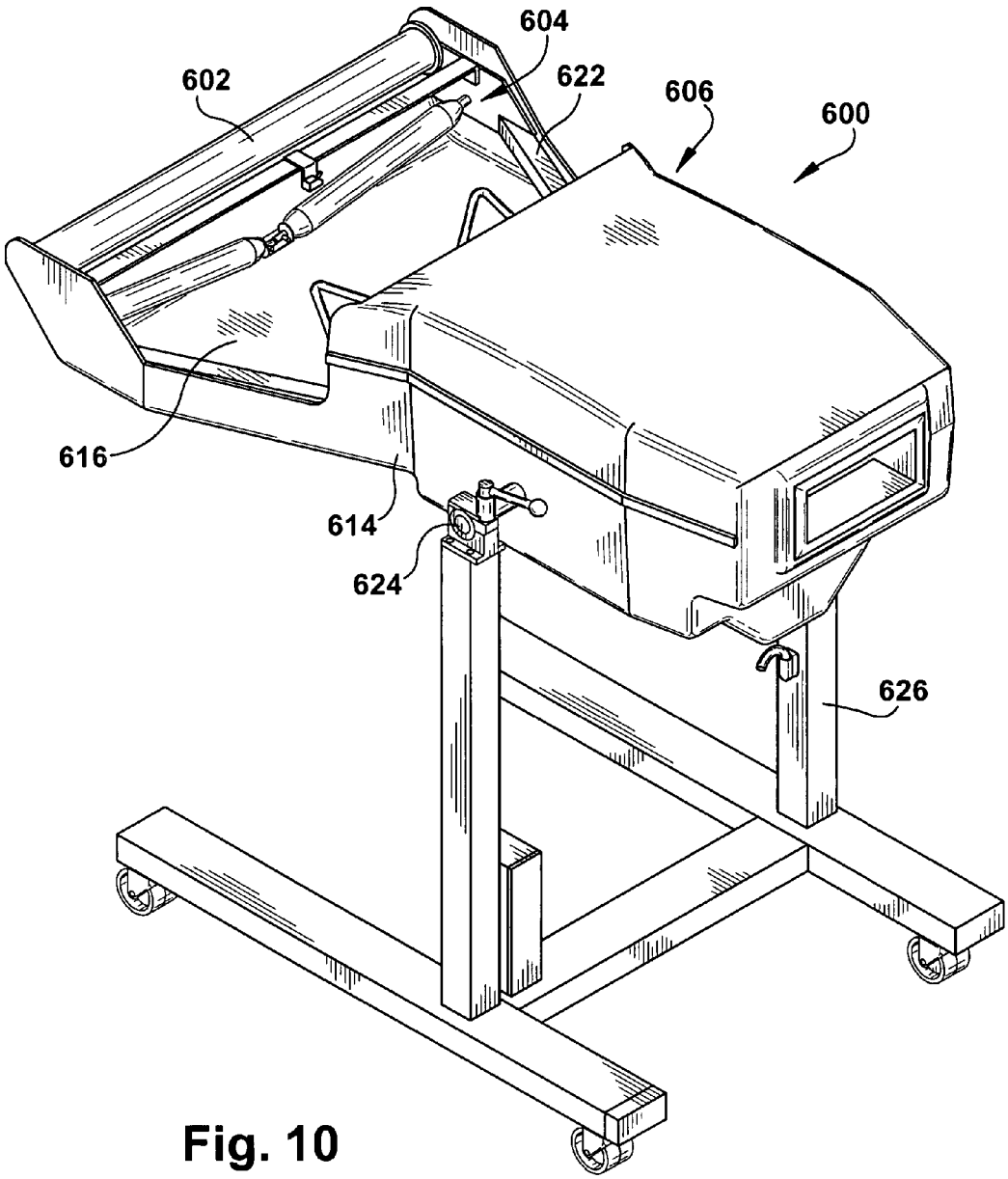
FIG. 10 is a perspective view of another dunnage conversion machine according to the invention.
Figure 11:
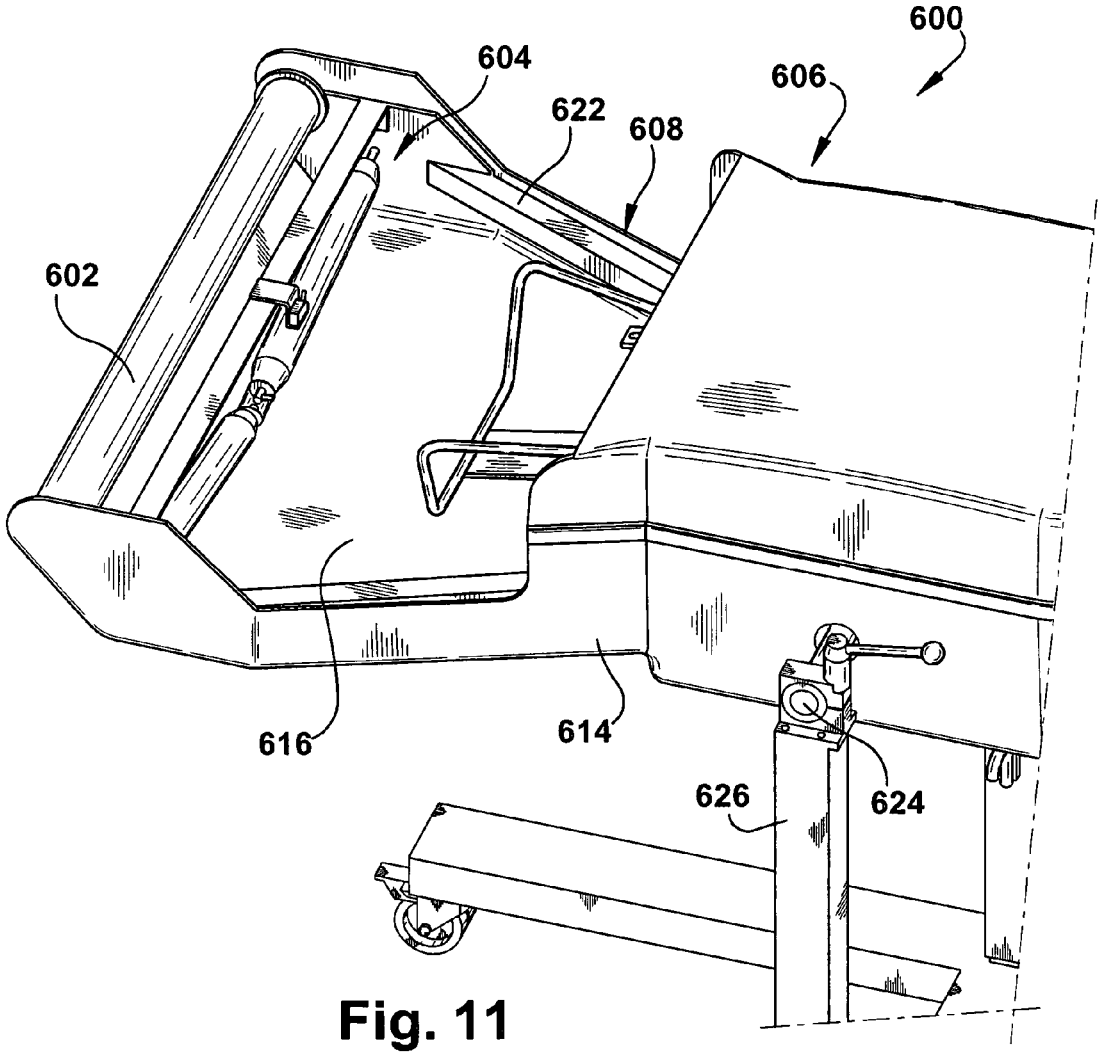
FIG. 11 is an enlarged view of a rear portion of the conversion machine of FIG. 10.
Figure 18:
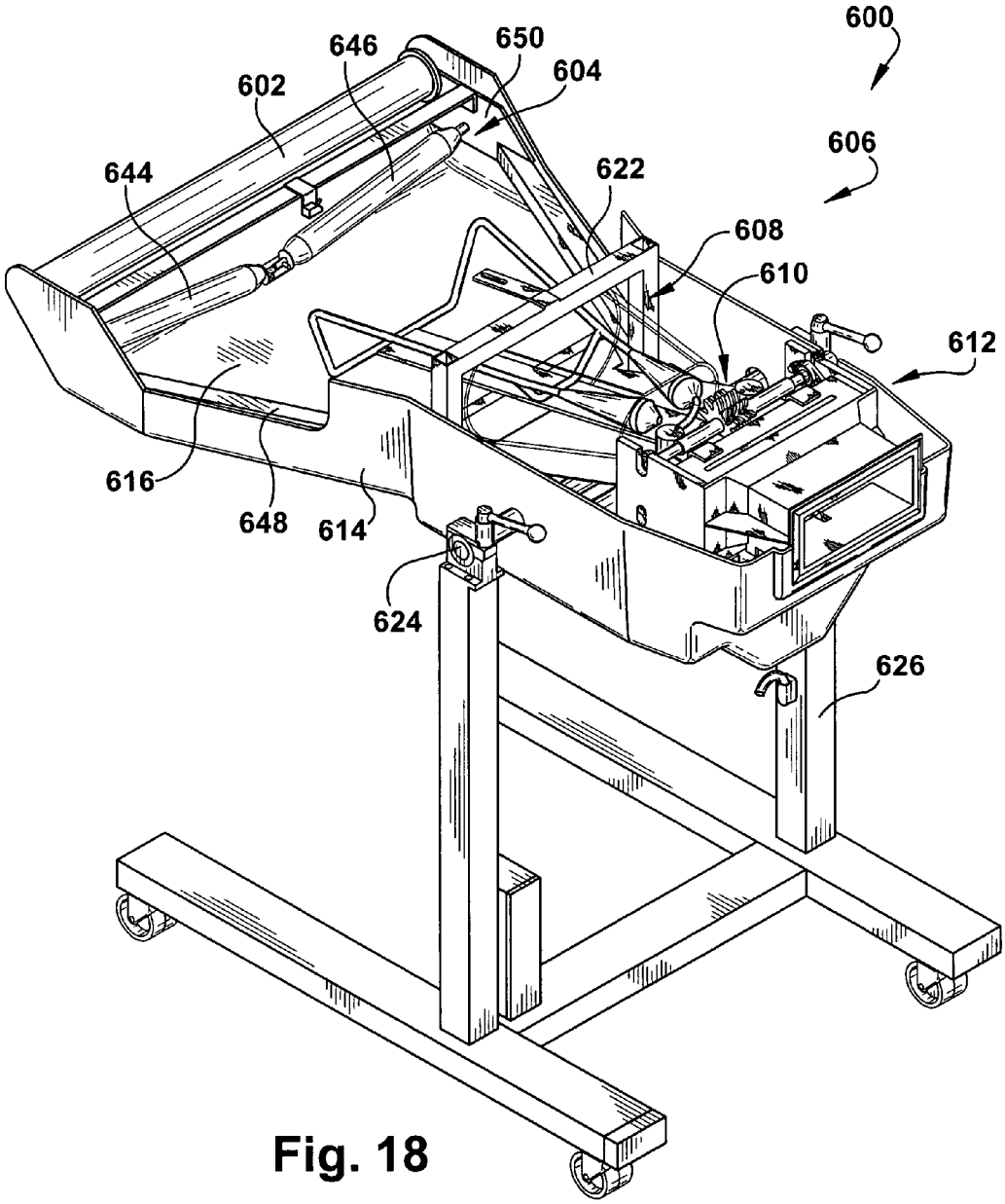
FIG. 18 is a perspective view of the conversion machine of FIG. 10 with the housing removed.
Figure 19:
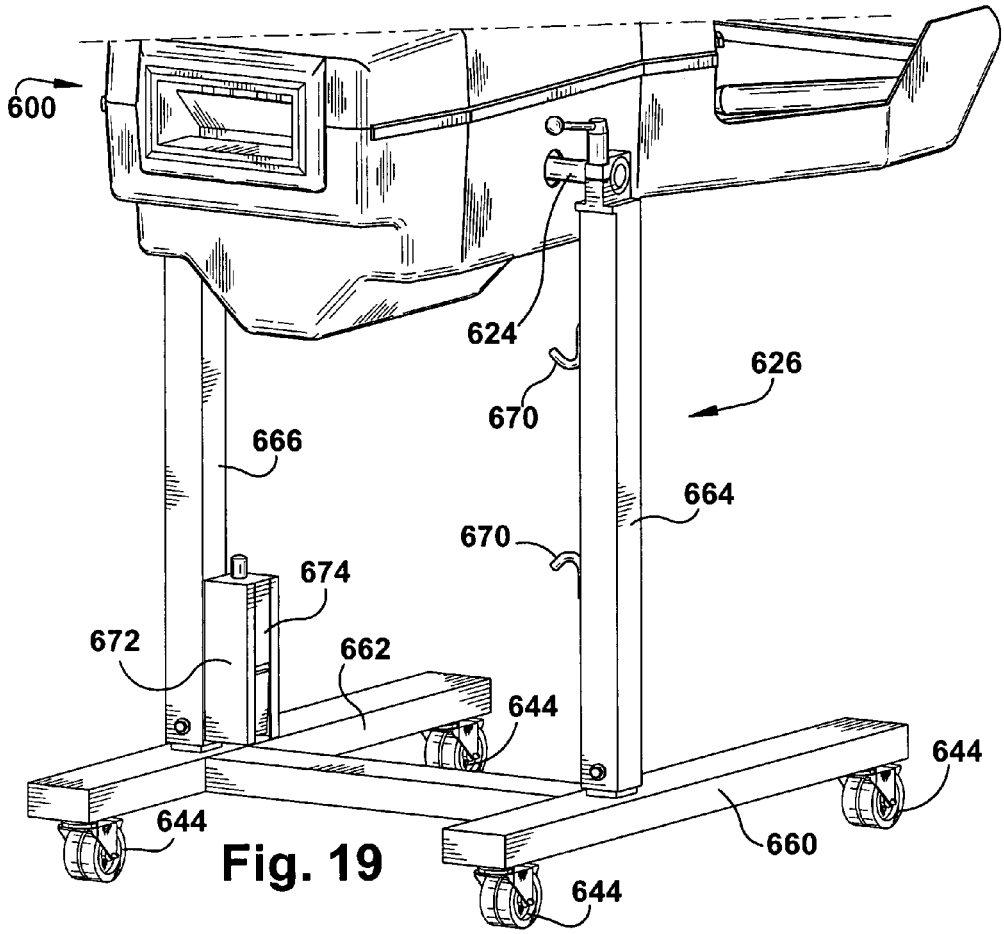
FIGS. 19 and 20 are enlarged perspective views of the conversion machine of FIG. 10, specifically of the stand.
Figure 20:
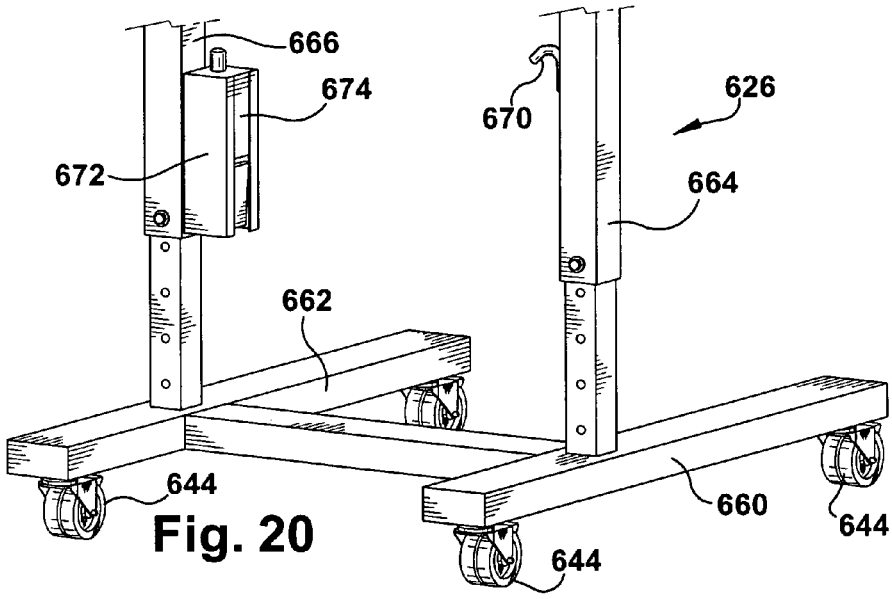

Another conversion machine 600 in accordance with the present invention is shown in FIGS. 10, 11 and 18. As in the previous embodiment, this conversion machine 600 includes a constant-entry roller 602, a tension-adjusting assembly 604, a conversion assembly 606 having both a forming assembly 608 and a feed assembly 610, and a severing assembly 612, each of which is substantially similar to respective assemblies and devices described above, unless otherwise noted. The conversion machine 600 also includes a housing 614 that substantially encloses the feed assembly 610, the severing assembly 612, and at least a portion of the forming assembly 608. A lower portion of the housing 614 extends upstream from the forming assembly 608 to the tension-adjusting assembly 604 and creates a tray 616 across which the stock material is drawn into the forming assembly 608. The tray 616 also provides a relatively flat surface between the tension-adjusting assembly 604 and the forming assembly 608 that facilitates splicing one or more plies of a new supply of sheet stock material to respective plies of the almost spent supply of stock material.

The conversion assembly 606 is mounted a frame 620. A support shaft 624 extends from the frame 622 of the conversion machine 600 and is rotatably mounted to a stand 626. The shaft 624 preferably passes through or near the center of gravity of the conversion machine 600 to facilitate rotating the conversion machine 600 about a generally horizontal axis. This minimizes the amount of weight that has to be rotated and makes it easier to rotate the machine 600 to dispense dunnage products at a desired location, to load a fresh supply of stock material, or to diagnose and repair problems with the conversion machine 600.

Figure 12:
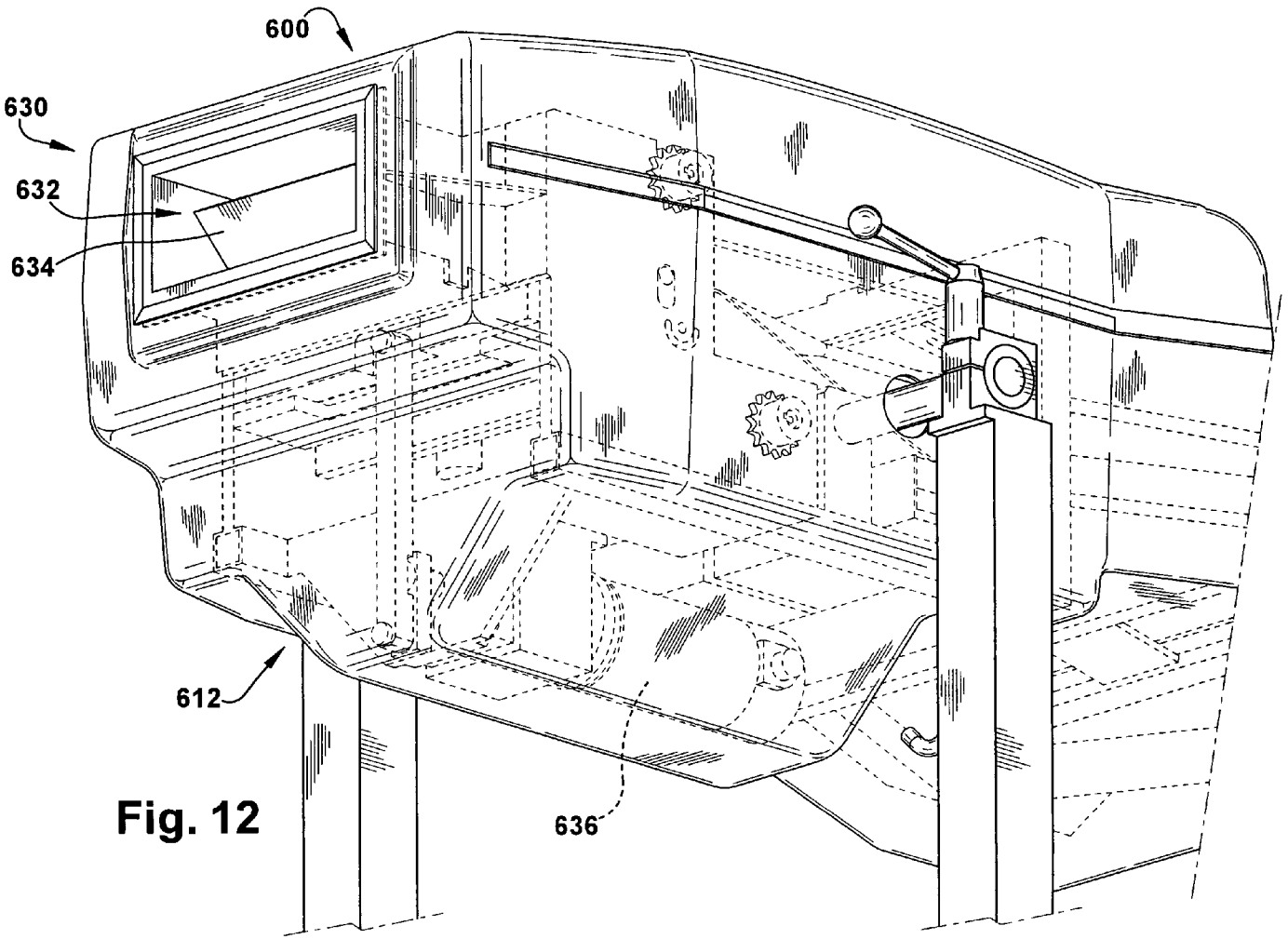
FIG. 12 is an enlarged view of a front portion of the conversion machine of FIG. 10, with the housing rendered transparent to illustrate internal components.
Figure 13:
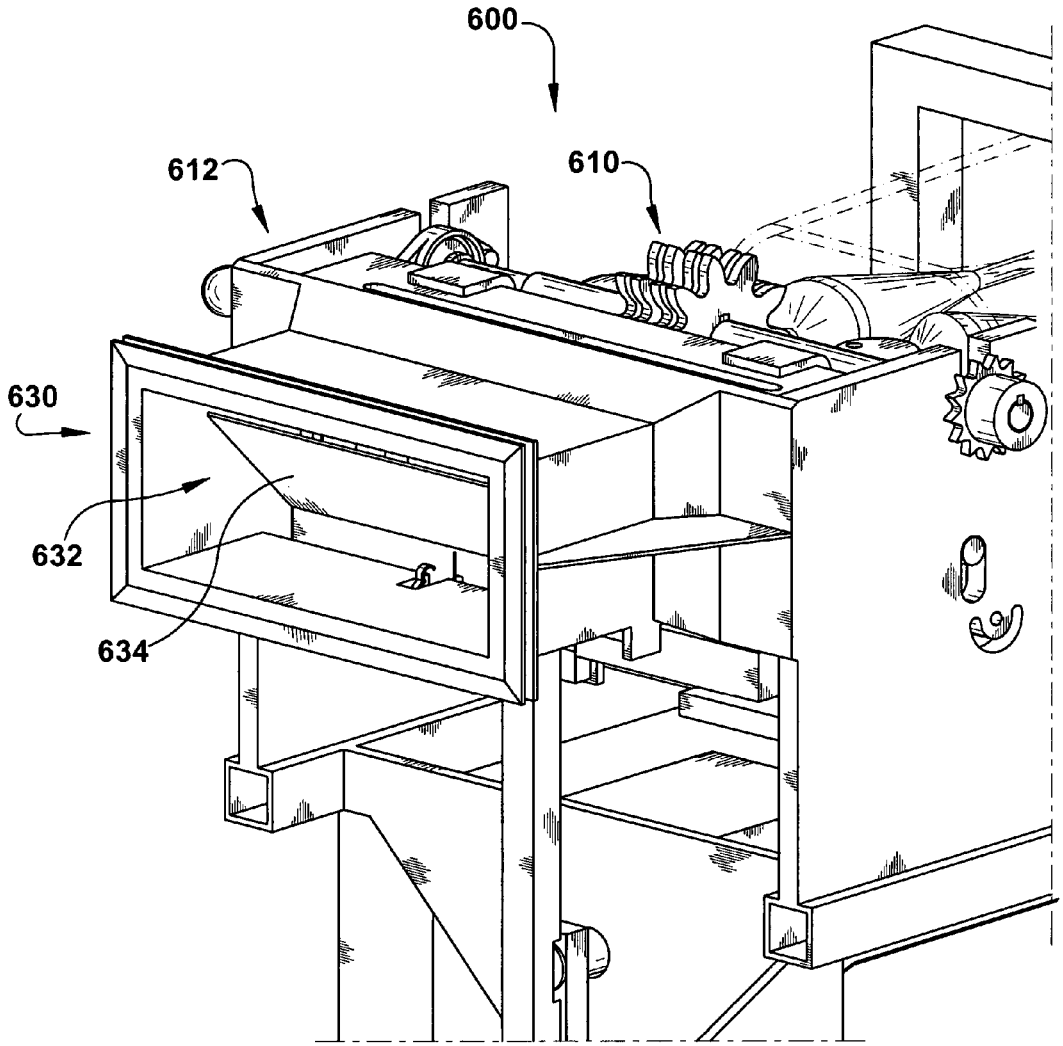
FIG. 13 is an enlarged perspective view of a front and upper portion of the conversion machine of FIG. 10 with the housing removed.
Figure 14:
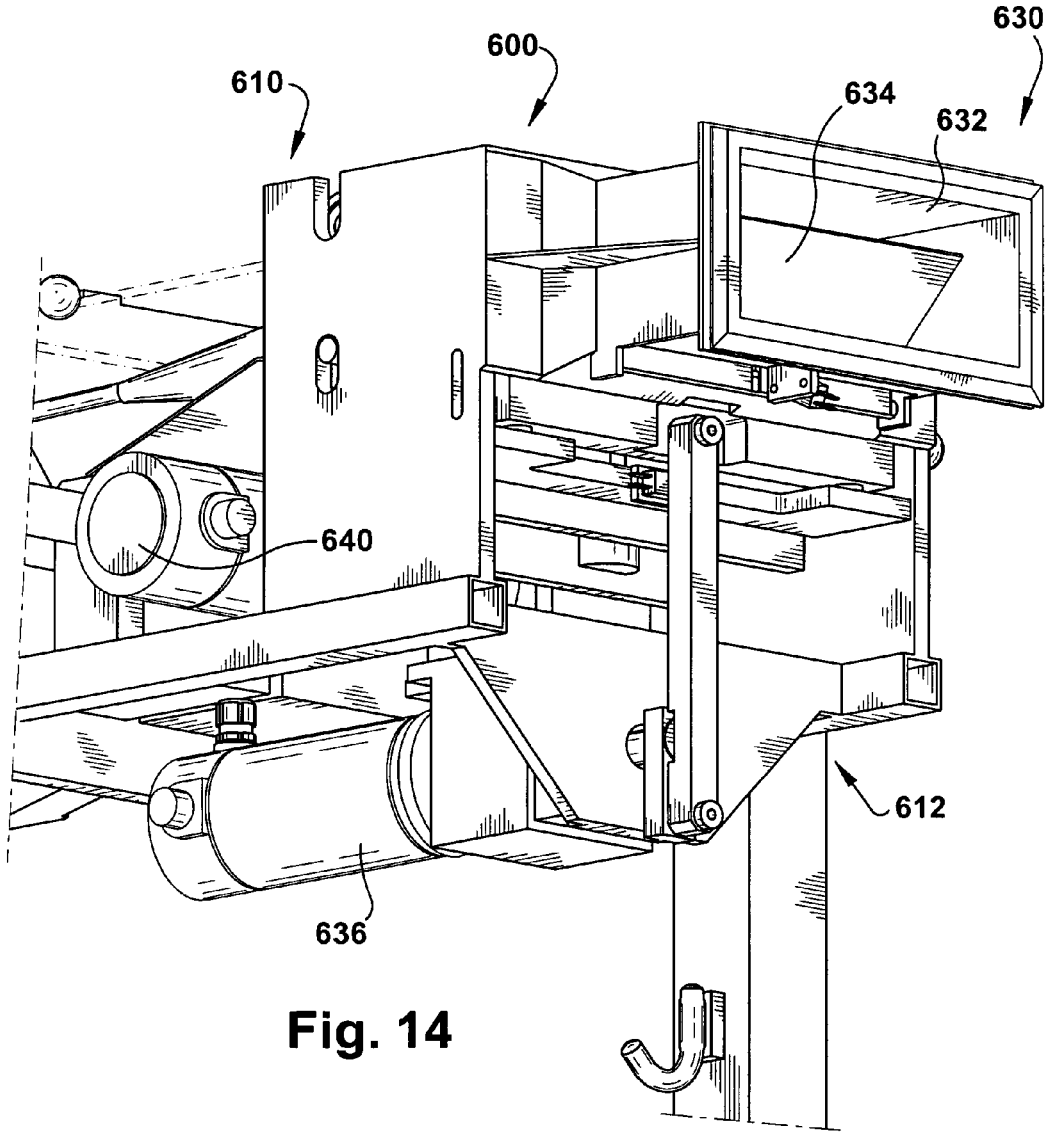
FIG. 14 is an enlarged perspective view of a front and lower portion of the conversion machine of FIG. 10 with the housing removed.

FIGS. 12-14 illustrate the components of the conversion machine 600 at the downstream end. Starting at the downstream end of the conversion machine 600, an output chute 630 includes an outlet valve 632 in the form of a flapper door 634 spring-biased to a closed position. The flapper door 634 is pivotally mounted for rotation about a hinge axis proximate a bottom portion of the output chute 630 and in the closed position extends downstream toward an upper portion of the output chute 630. In operation, as a strip of dunnage enters the output chute 630 it pushes against the flapper door 634, which rotates downward against the spring-biasing force toward the bottom portion of the output chute 630.

The severing assembly 612 upstream of the output chute 630 can be controlled to prevent activation in the event that the flapper door 634 is opened beyond a predetermined acceptable rotational limit that would indicate that something else in addition to or in place of the strip of dunnage could pass the flapper door 634 and interfere with the severing operation. The severing assembly 612 includes a severing motor 636 that is mounted generally below the feed assembly 610 and is oriented parallel to the longitudinal axis of the conversion machine 600.

Figure 15:
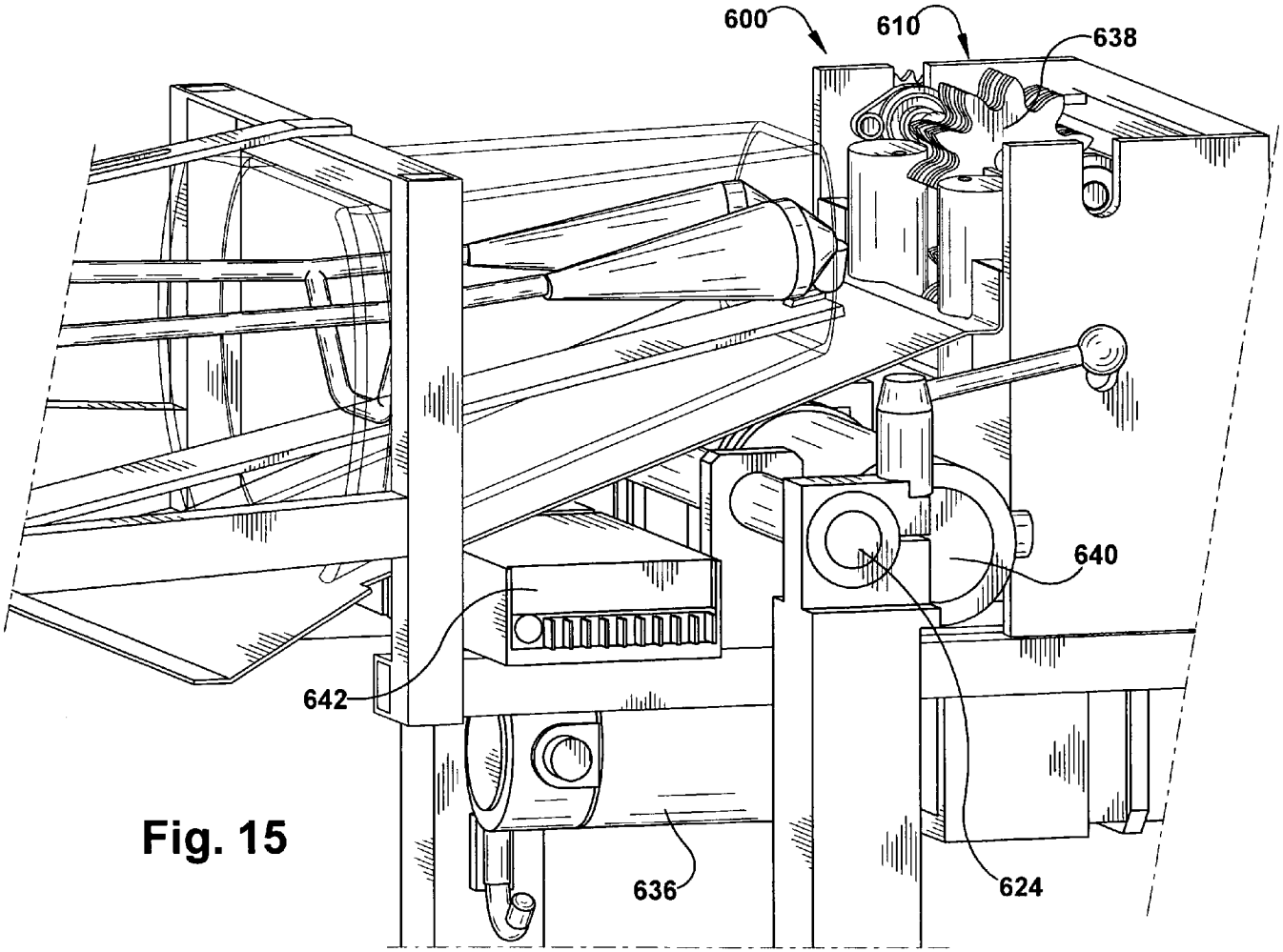
FIG. 15 is an enlarged side perspective view of the conversion machine of FIG. 10 with the housing removed.
Figure 16:
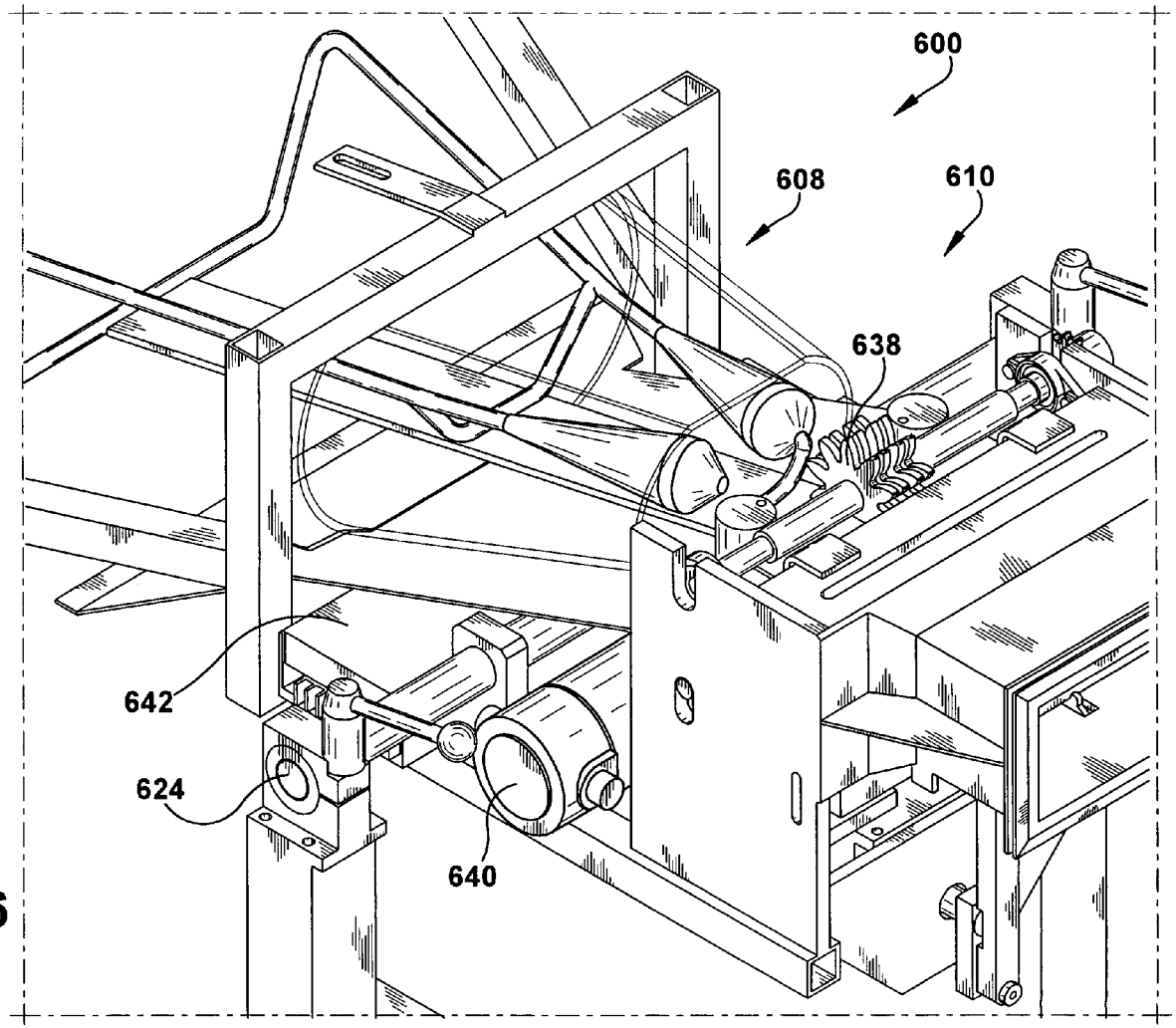
FIG. 16 is an enlarged perspective view of the conversion machine of FIG. 15 down from a position beside the conversion machine.

As shown in FIGS. 14-16, the feed assembly 610, upstream of the severing assembly 612, includes rotating members 638 (one shown) driven by a feed motor 640. The feed motor 640 is mounted above the severing motor 636 and is oriented generally transverse the longitudinal direction of the conversion machine 600 and transverse the severing motor 636.

Moving upstream, the forming assembly 608 is mounted upstream of the feed assembly 610, as in the conversion machine 10 shown in FIG. 1, and a power supply unit 642 is mounted near the feed motor 640 on the other side of the support shaft 624. The power supply unit 642 distributes electrical power from a source to the feed motor 640 and the severing motor 636.

Figure 17:
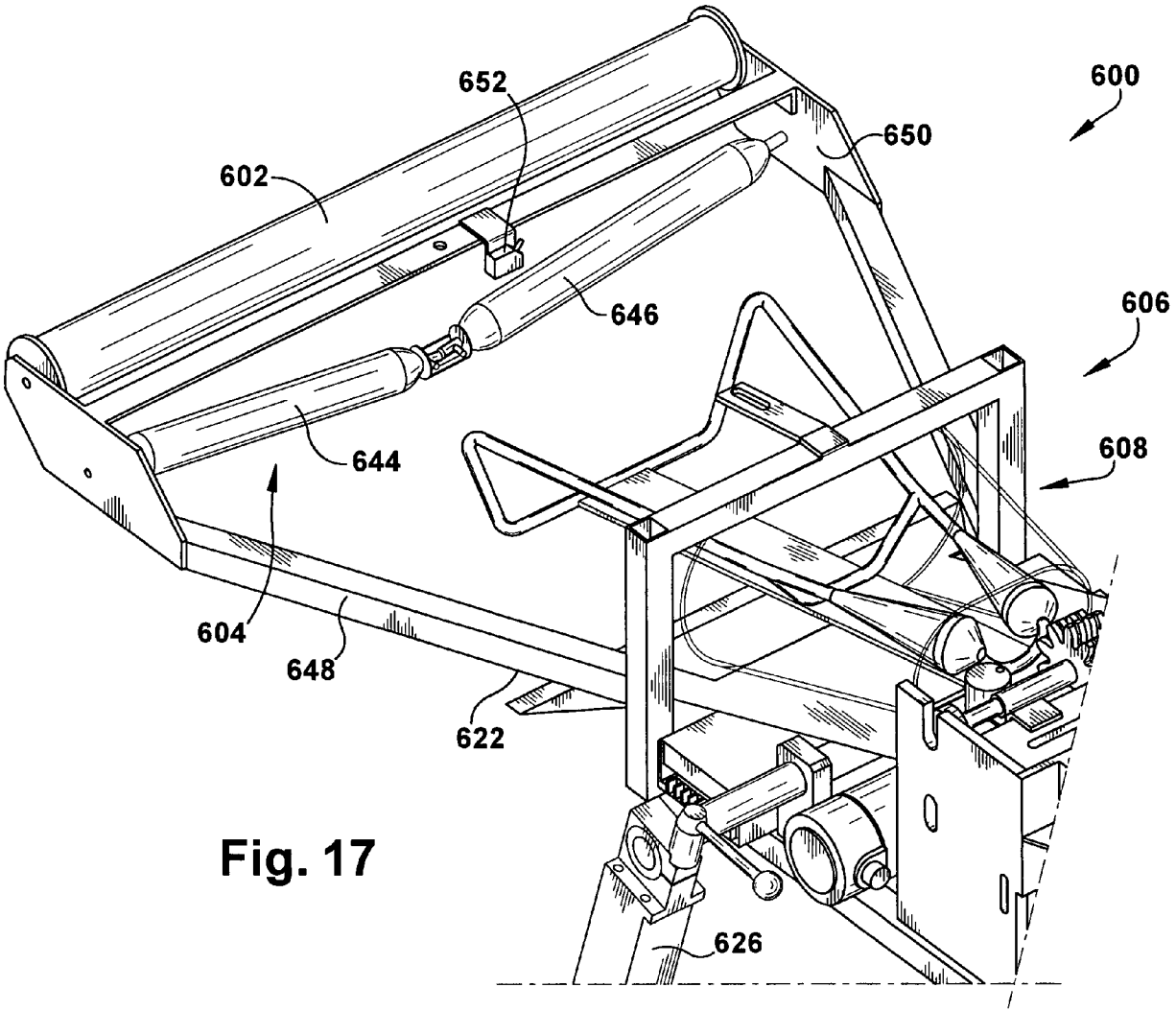
FIG. 17 is an enlarged perspective view of the conversion machine as seen in FIG. 11 with the housing removed.

Referring now to FIGS. 17 and 18, a lower portion of the housing 614 extends upstream from the forming assembly 608 to the tension-adjusting assembly 604. This portion of the housing 614 forms the tray 616 between the upstream end of the forming assembly 608 and the tension-adjusting assembly 604. The tray 616 has a relatively flat surface that facilitates splicing one or more plies of a new supply of sheet stock material to a respective ply or plies of a nearly spent supply of stock material.

The illustrated tension-adjusting assembly 604 includes a pair of rotatable rollers 644 and 646 that are aligned end-to-end. The outer ends of the rollers 644 and 646 are rotatably mounted in a pair of spaced-apart arms 648 and 650 extending upstream from or forming a part of the frame 622 of the conversion machine 600. Each roller 644 and 646 is generally cylindrical with rounded ends. The longitudinal axes of the rollers 644 and 646 are transverse each other, such that the rollers 644 and 646 are inclined relative to a straight line extending through either their inner or their outer ends. The joint between the rollers 644 and 646 is adjustable to change the relative angle of inclination between the rollers 644 and 646.

The illustrated conversion machine 600 also includes an end-of-web detection sensor 652, such as a photosensor, positioned to detect the absence of the sheet stock material. The end-of-web sensor 652 can be used to stop the conversion machine 600 to allow an operator to splice the leading end of a new supply of stock material to the trailing end of the almost-spent supply before the trailing end passes through the conversion assembly 606. Typically this means that the end-of-web sensor 652 is connected to a controller (not shown) that controls the operation of the feed assembly 610. The constant-entry roller 602 also is journalled between the spaced-apart arms 648 and 650 upstream of the tension-adjusting assembly 604 to provide a constant entry point for the stock material as the stock material is drawn from the supply.

A supply of sheet stock material, either in roll form or in the form of a fan-folded stack, can be mounted to the stand 626. Referring now to FIGS. 19-23, the illustrated stand 626 includes a pair of laterally spaced-apart feet 660 and 662 having wheels 644 mounted thereto for moving the conversion machine 600. A pair of upright legs 664 and 666 elevate the frame 622 of the conversion machine 600 above the feet 660 and 662 and the length of the upright legs 664 and 666 can be telescopically adjusted. The upright legs 664 and 666 also include a pair of cable guides 670 for storing a power cable (not shown) and a bracket 672 for supporting a foot pedal 674 or other control mechanism while the conversion machine 600 is being transported from one place to another.

Figure 21:
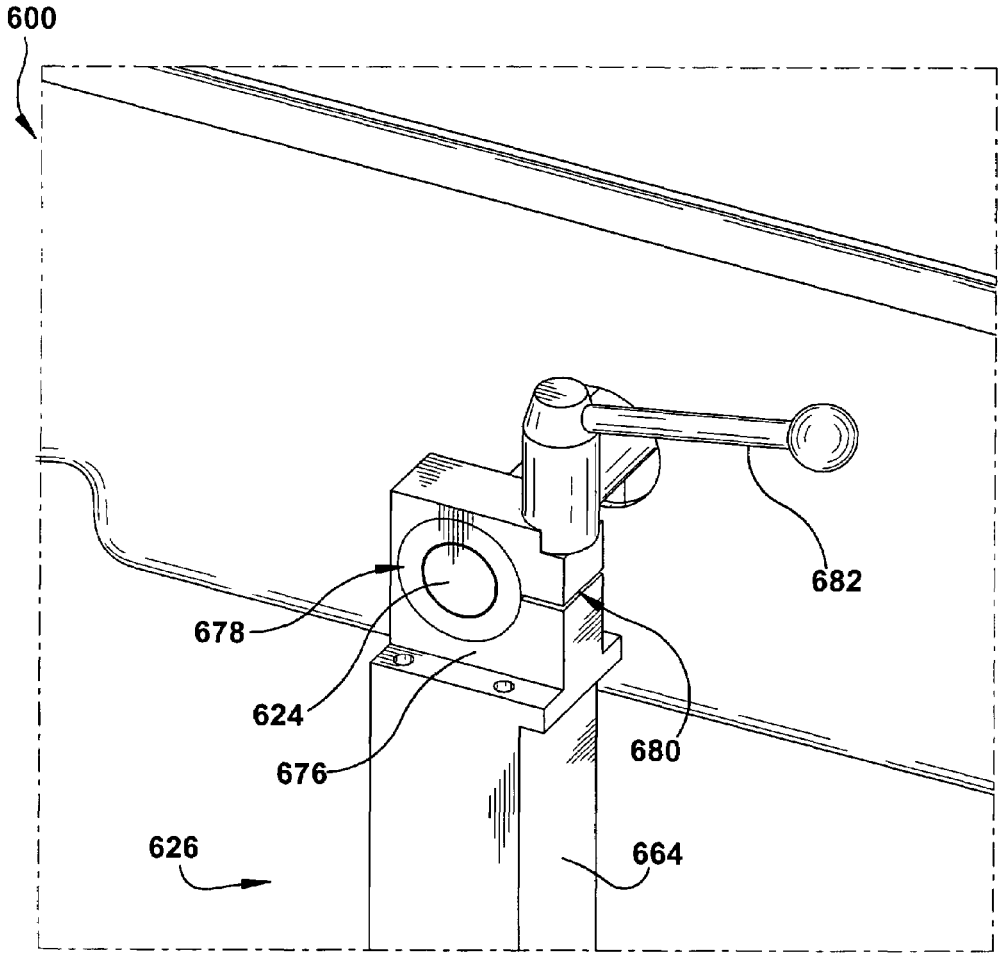
FIG. 21 is an enlarged perspective view of a tilt-locking mechanism portion of the conversion machine of FIG. 10.
Figure 22:
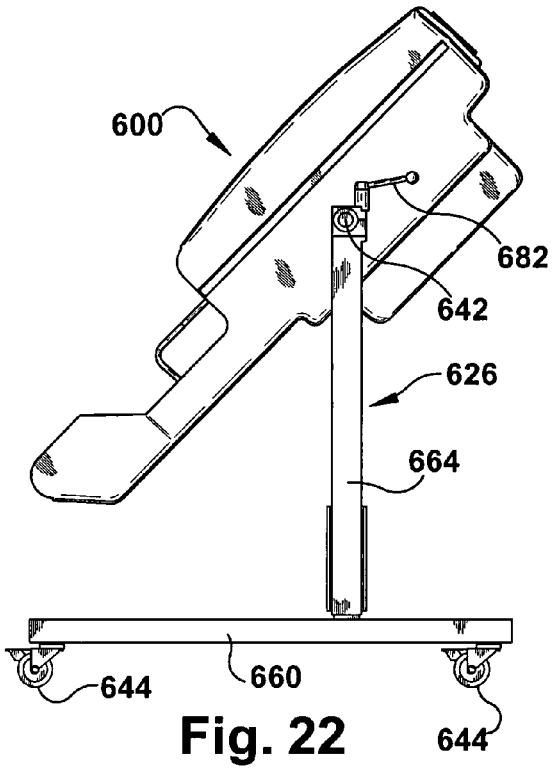
FIGS. 22 and 23 are perspective views of the conversion machine of FIG. 10 at two different orientations relative to the stand.
Figure 23:
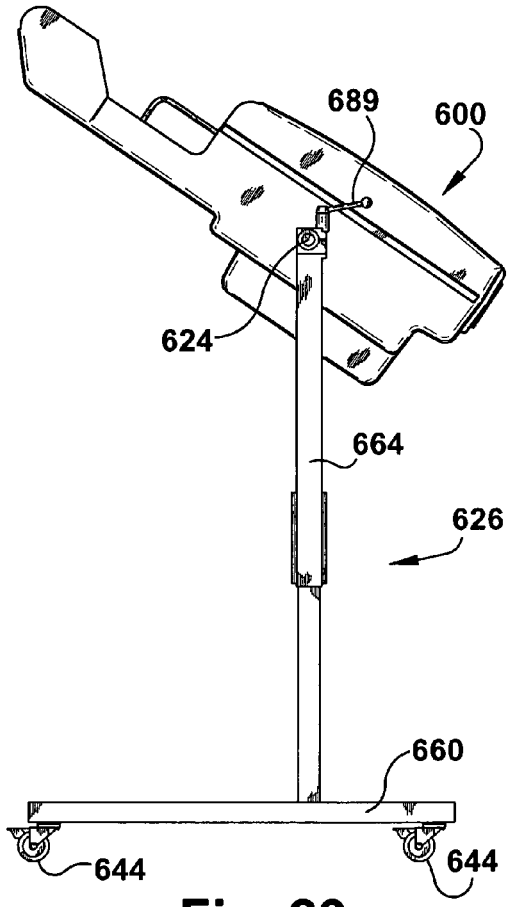

The upright legs 664 and 666 of the stand 626 rotatably support the support shaft 624 extending from the frame 622 (FIG. 18) of the conversion machine 600. As shown in FIGS. 21-23, a block 676 at the upper end of the upright leg 664 has a circular opening 678 that receives the support shaft 624 therein. One side of the block 676 has an slot 680 extending to the circular opening 678 and a threaded pin (not shown) spanning the slot. The threaded pin protrudes from the block, and a nut with an integral handle 682 is mounted on the exposed end of the pin. By tightening the nut 682, the block 676 can be tightened on the support shaft 624 to hold the conversion machine 600 at the desired angle. The longitudinal axis of the illustrated conversion machine 600 can be tilted up to about forty-five degrees from horizontal either clockwise or counterclockwise about the axis of the support shaft 624 for operation. The conversion machine 600 can be rotated further, including one hundred eighty degrees, for maintenance or loading a new supply of stock material.

The ability to rotate the conversion machine 600 about a generally horizontal axis and hold it in any position, as well as the ability to change the height of the conversion machine, facilitates positioning the conversion machine 600 in the position most advantageous for the operator for dispensing dunnage, for loading sheet stock material, including splicing, or for maintenance, such as replacing a motor or clearing a jam, for example.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention might have been described above with respect to only one of several illustrated embodiments, such feature can be combined with one or more other features of the other embodiments, as can be desired and advantageous for any given or particular application.

What is claimed:

1. A dunnage conversion machine for converting a supply of sheet stock material into a relatively less dense dunnage product, comprising: a conversion assembly that converts sheet stock material into a dunnage product; and at least two transversely extending members having respective longitudinal axes, where each transversely extending member has a circular radial cross-sectional shape which changes size along its axial dimension, where each transversely extending member is independently rotatable about a respective longitudinal axis, the transversely extending members are disposed upstream of the conversion assembly in a substantially end-to-end arrangement, and the transversely extending members are fixedly mounted with respect to one another, with respective axes inclined to one another.

2. A conversion machine as set forth in claim 1, wherein the transversely extending members are arrayed along a straight line.

3. A conversion machine as set forth in claim 1, wherein the transversely extending members are disposed in a path of the stock material along a curve extending widthwise across the path of the stock material.

4. A conversion machine as set forth in claim 1, wherein the transversely extending members are arrayed along a curved line.

5. A conversion machine as set forth in claim 1, wherein at least one transversely extending member is a roller.

6. A conversion machine as set forth in claim 1, wherein at least one of the transversely extending members has at least one rounded end.

7. A conversion machine as set forth in claim 1, wherein the transversely extending members includes a sequence of transversely extending members that includes at least three transversely extending members.

8. A conversion machine as set forth in claim 1, wherein the conversion assembly includes a forming assembly that shapes the sheet stock material and a feeding/fixing assembly that draws the stock material through the forming assembly and fixes the shaped stock material to form a dunnage product.

9. A conversion machine as set forth in claim 1, further comprising a constant-entry roller upstream of the transversely extending members that provides a constant point in the path of the stock material from a supply to the transversely extending members.

10. A conversion machine as set forth in claim 1, wherein the transversely extending members define a transversely-extending curved outer surface across which the stock material is drawn.

* * * * *